US005469834A

United States Patent [19]

Higgins et al.

[11] Patent Number: 5,469,834

[45] Date of Patent: Nov. 28, 1995

[54] ARCHERY BOW WITH TILTING AND TRANSLATING GRIP

[75] Inventors: Ronald Higgins; Allan F. Smith, both of Tucson, Ariz.

[73] Assignee: Precision Shooting Equipment, Inc., Tucson, Ariz.

[21] Appl. No.: 304,152

[22] Filed: Sep. 12, 1994

[51] Int. Cl.[6] ..... F41B 5/14

[52] U.S. Cl. ..... 124/88; 124/23.1

[58] Field of Search ..... 124/88, 86, 23.1, 124/25.6

[56] References Cited

U.S. PATENT DOCUMENTS

| | | | |
|---|---|---|---|
| 3,176,674 | 4/1965 | Smith | 124/23.1 |
| 3,407,799 | 10/1968 | Reynolds | 124/24.1 |
| 3,538,902 | 11/1970 | Fowkes | 124/88 |
| 3,599,621 | 8/1971 | Scrobell | 124/88 X |
| 4,175,536 | 11/1979 | Carella | 124/23.1 |
| 4,252,100 | 2/1981 | Rickard | 124/88 X |
| 4,966,124 | 10/1990 | Burling | 124/88 X |
| 5,243,958 | 9/1993 | Shepley, Jr. | 124/88 |

*Primary Examiner*—Anthony Knight
*Attorney, Agent, or Firm*—Cahill, Sutton & Thomas

[57] ABSTRACT

The grip for an archery bow is attached to the handle of the bow and can translate (move from side to side) and tilt. The grip is attached to the handle by two screws engaging threaded inserts screwed into the handle. The position of the threaded inserts in the handle determines the side to side position of the grip. The screws pass through elongated slots in one side of the grip, with the slots elongated in different directions, thus enabling one to adjust the tilt of the grip relative to the handle. The threaded inserts are preferably held in position by locking inserts engaging the threaded inserts within the handle.

9 Claims, 1 Drawing Sheet

ARCHERY BOW WITH TILTING AND TRANSLATING GRIP

BACKGROUND OF THE INVENTION

This invention relates to archery bows and, in particular, to a grip having an adjustable tilt and a separate, adjustable lateral displacement relative to the handle of an archery bow.

Whether hunting or target shooting, an archer strives to develop a consistent form to achieve accuracy with each shot. Various sights, counterweights, and other accessories are available to help the archer achieve this purpose. One item, which is on every bow, that is often overlooked is the grip. A grip is typically a wooden or plastic piece which is curved or shaped to fit the hand of the archer. The grip may be formed as part of the bow itself or be a separate piece. For bows having detachable limbs, the grip is typically a separate piece of wood, plastic, or metal attached to the handle.

Seen from above, an archer holding a bow at full draw forms a triangle. The arrow is one side of the triangle, extending from the archer's hand (or release mechanism) to the arrow rest, which is attached just above the grip. The archer's arm is the second side of the triangle. The archer's torso forms the third side of the triangle. The angle between the arm of the archer and the arrow depends on the archer's style, the draw length of the bow, and the size of the archer.

A handle is typically made from aluminum or other light metal or alloy and is wider front to back (in the direction of the arrow) than it is from side to side. The grip is aligned with the handle, i.e. with the arrow, not with the archer's arm. The archer thus holds the grip slightly turned in his hand or else bends his wrist backward slightly to hold the grip squarely. An archer may also have to tilt his wrist in order to hold the bow vertically. As used herein, bending the wrist means moving the hand out of the plane of the bones of the forearm and tilting the wrist means twisting the hand up and down in the plane of the bones of the forearm. Since a bent or tilted wrist is weaker than a straight wrist, an inconsistency can occur as the archer changes his hold on the bow either through fatigue or lack of concentration or as the archer moves the bow as the arrow is released.

Adjustable grips are known in the prior art and generally fall into one of two types. The first type is a grip that is adjustable front to rear, in the direction of the arrow. U.S. Pat. No. 4,175,536 (Carella) discloses a grip of this type. The second type is a grip that is connected to the handle by a ball and socket joint. U.S. Pat. No. 3,407,799 (Reynolds) discloses a grip of the second type. While permitting a grip to rotate in several directions, the second type of grip concentrates the draw force in the ball and socket joint and is difficult to position consistently.

U.S. Pat. No. 5,243,958 (Shepley, Jr.) discloses a rugged, laterally adjustable grip in which the grip is attached to the handle of a bow by threaded inserts in the handle. It is disclosed that the threaded inserts can be attached to the handle by press fit, external threads, or adhesive. The handle is held in place by opposed screws through each side of the handle.

The draw length of a bow is the distance from the nocking point to the grip at full draw. An adjustable grip may change the draw length of a bow as the position of the grip is changed. Changing the draw length can change the draw force characteristics of the bow. It is highly desirable that adjusting the grip not trigger a series of adjustments, amounting to completely re-tuning the bow.

In view of the foregoing, it is therefore an object of the invention to provide an improved ergonomic grip for an archery bow.

Another object of the invention is to provide a grip having an adjustable tilt relative to the handle of an archery bow.

A further object of the invention is to provide a grip which couples the draw force to the handle by at least two points of contact.

Another object of the invention is to provide a grip that can translate along and rotate about an axis in independent motions.

A further object of the invention is to provide an adjustable, tilting grip which does not change the draw length of a bow when the grip is adjusted.

SUMMARY OF THE INVENTION

The foregoing objects are achieved by the invention in which a grip is attached to the handle of the bow and can translate (move from side to side) and tilt. The grip is attached to the handle by two screws engaging threaded inserts screwed into the handle. The position of the threaded inserts in the handle determines the side to side position of the grip. The screws pass through elongated slots in one side of the grip, with the slots elongated in different directions, thereby enabling one to adjust the tilt of the grip relative to the handle. The threaded inserts are preferably held in position by locking inserts engaging the threaded inserts within the handle.

BRIEF DESCRIPTION OF THE DRAWINGS

A more complete understanding of the invention can be obtained by considering the following detailed description in conjunction with the accompanying drawings in which.

DETAILED DESCRIPTION OF THE INVENTION

Figures 1, 2, 3, 4, 5:
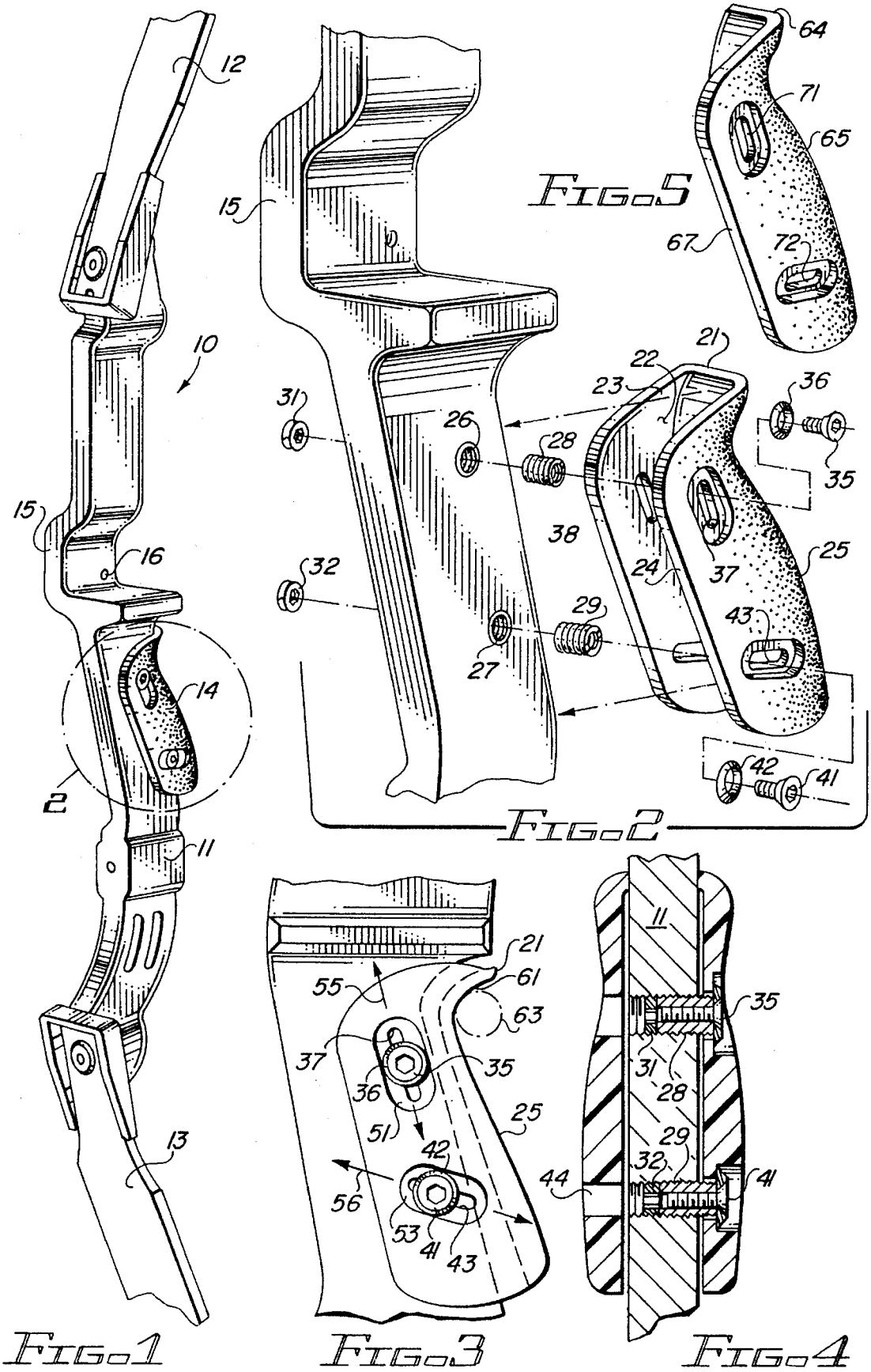
FIG. 1 illustrates a partial view of a bow having a grip constructed in accordance with a preferred embodiment of the invention.
FIG. 2 is an exploded view of the grip shown in FIG. 1.
FIG. 3 is a side view of a grip constructed in accordance with preferred embodiment of the invention.
FIG. 4 is a cross-sectional view of a grip constructed in accordance with a preferred embodiment of the invention.
FIG. 5 illustrates a grip constructed in accordance with an alternative embodiment of the invention.

In FIG. 1, bow 10 includes handle 11 having limbs 12 and 13 attached to each end thereof. Grip 14 straddles handle 11 at a point below offset 15 containing threaded hole 16 for receiving an arrow rest (not shown). As shown in FIG. 1, handle 11 is wider front-to-rear than it is from side to side. If an archer were to hold bow 10 by grip 14 with his wrist straight, the bow string would rest on or be very close to the upper arm of the hand holding the bow. In addition, depending upon the shape of the archer's hand, the bow string may not be vertical when the bow is held with the arm horizontal. In order for the bow string to be vertical, grip 14 may have to tilt relative to handle 11.

FIG. 2 illustrates the construction of a grip which can translate and can tilt relative to the handle, thereby accommodating a wide variety of archers' preferences. Specifically, grip 21 includes central channel 22 between sides 23 and 24 and contoured back 25 opposite channel 22. Channel 22 is wider than the thickness of handle 11, permitting grip 21 to move from side to side. The region of handle 11 straddled by grip 21 includes threaded bore 26 and threaded bore 27. Threaded insert 28 is located in bore 26 and threaded insert 29 is located in bore 27.

The side to side positions of inserts 28 and 29 determine the side to side position of grip 21. To some extent, threaded inserts 28 and 29 can be set to different depths within bores 26 and 27 but are generally set to approximately the same depth within handle 11. Locking inserts 31 and 32 are threaded into the opposite ends of bores 26 and 27 from inserts 28 and 29. Locking inserts 31 and 32 are tightened against inserts 28 and 29 after inserts 28 and 29 have been set to their desired position. Access to the locking inserts is through slots 38 and 44 in side 23.

Inserts 28 and 29 have both internal and external threads. Insert 28 receives screw 35 which is inserted through conical washer 36 and slot 37 in side 24 of grip 21. Similarly, screw 41 is inserted through conical washer 42 and slot 43 to engage threaded insert 29. Each threaded insert has one end slotted to receive a screwdriver. Each locking insert has a faceted center hole to receive an Allen wrench.

FIG. 3 is a side view of grip 21 showing the motion of grip 21 relative to screws 35 and 41. Because of the rounded contour of sides 23 and 24, slot 37 and slot 43 are preferably surrounded by recesses 51 and 53 as illustrated in FIG. 3. Recesses 51 and 53 are flat surfaces for supporting conical washers 36 and 42, respectively, and for providing a large contact area between the washers and the grip.

Slot 37 and slot 43 are elongated in different directions to provide the desired tilt of grip 21. In theory, one slot could be replaced by a circular hole if the other slot were perpendicular to a line connecting the two screws. This configuration would enable the slotted portion of grip 21 to rotate in or out but is not preferred because the motion of the grip would change the draw length.

In accordance with a preferred embodiment of the invention, the slots are elongated in different directions thereby requiring a sliding action along both screws in order for the grip to change position. The angle between the slots is not critical. As illustrated in FIG. 3, slot 37 is approximately parallel to back 25 and slot 43 is at an angle of approximately sixty degrees to back 25. The particular angles are by way of example only.

As grip 21 moves upward, as indicated by arrow 55, the lower portion of the grip is constrained to move inward, as indicated by arrow 56, because of the orientation of slot 43. Thus, grip 21 can rotate and move along an axis perpendicular to the plane of FIG. 3. These two motions are completely independent of one another since one is controlled by the position of the threaded inserts and the other is controlled by the slots.

Slots 37 and 43 combine to produce a motion which rotates depression 61 about circle 63. Circle 63 represents the approximate location of the portion of the hand between the thumb and forefinger which rests in depression 61. Since the grip rotates about a center adjacent the depression in the grip, the draw length does not change when grip 21 is adjusted.

FIG. 4 illustrates the translation of grip 21 as the positions of inserts 28 and 29 are changed within handle 11. The maximum amount of translation is equal to the difference between the width of channel 22 and the thickness of handle 11. The position of the grip is changed by loosening locking inserts 31 and 32, setting threaded inserts 28 and 29 to the desired position, and then tightening the locking inserts.

In order to prevent the insert from turning when adjusting tilt, the friction between the insert and the handle must be greater than the friction between the screw and the insert. The locking insert accomplishes this by jamming the threaded insert against the threads in the handle, as shown in FIG. 4. There are alternatives. In standard hardware, the threads on a bolt have a V-shaped cross-section, as do the threads on a nut. The V's do not fully engage, i.e. the peak on a screw thread does not go all the way into the valley in a thread on a nut. A tap drill size typically gives what is known as a seventy-five percent thread, i.e. the peak on a screw thread only extends about seventy-five percent of the way into the valley in a thread on a nut. This reduces stress on the bolt and nut and makes the bolt much easier to rotate in the nut.

Friction between the handle and the insert can be made greater than the friction between the insert and the screw by (1) using a screw having a finer pitch thread than the outside thread of the insert, (2) increasing the percent thread (drilling undersize holes in the handle for tapping) and/or (3) filling the remaining twenty-five percent. The remaining twenty-five percent can be filled either by a plastic plug in the outside threads of the insert, as in a self-locking nut, or by wrapping the insert with Teflon® tape prior to threading the insert into the handle.

The outside diameter of threaded inserts 28 and 29 is a matter of design, it being understood that one needs to provide a suitable contact area for pinching the side of the grip between the washers and the threaded inserts. Grip 21 can be made of any suitable material, preferably molded plastic. In one embodiment of the invention, grip 21 was plastic, threaded inserts 28 and 29 were steel and had an outside diameter of 0.375 inches, and washers 36 and 42 were plastic and had an outside diameter of 0.563 inches.

FIG. 5 illustrates a narrow grip having a back and only one side. Grip 64 is attached to a bow handle in the same manner as grip 21 and is adjusted in the same way. Grip 64 is substantially narrower than grip 21 because grip 64 includes contoured back 65 and side 67. There is no second side. Grip 64 can be used with handles of different thicknesses and has the additional advantage of being adjustable from side to side by an amount determined only by the length of the threaded insert.

The invention thus provides an improved ergonomic grip for archery bows in which the grip can translate and tilt. The two motions of the grip are continuously (as opposed to incrementally) adjustable and completely independent and the draw force of the bow is transferred to the handle by at least two points of contact.

Having thus described the invention, it will be apparent to those of skill in the art that various modifications can be made within the scope of the invention. The particular hardware shown is a matter of design. For example, one could substitute round head screws for screws 35 and 41 and and flat washers for washers 36 and 42. The construction of the handle and grip be reversed, i.e. slots in the handle and bolts through inserts in the grip. A grip can be made to tilt only.

What is claimed is:

1. An archery bow having a translating, tilting grip, said bow comprising:

a handle having a predetermined thickness;

a grip having a first side and a contoured back;

a pair of threaded inserts in said handle;

a pair of slots in said first side, wherein said slots are elongated in different directions;

a pair of screws passing through said slots and engaging said threaded inserts for securing said grip to said handle;

wherein said inserts are movable from side to side in said handle for translating said grip and wherein said screws can move within said slots for changing the tilt of said grip relative to said handle.

2. The archery bow as set forth in claim 1 wherein each of said slots is surrounded by a recess and said bow further comprises a pair of washers, one washer fitting around each screw and riding in the recess.

3. The archery bow as set forth in claim 1 and further comprising:

a pair of locking inserts in said handle for holding said threaded inserts in place.

4. The archery bow as set forth in claim 3 wherein said threaded inserts are slotted for adjustment by a screwdriver and said locking inserts are internally faceted for adjustment by an Allen wrench.

5. The archery bow as set forth in claim 1 wherein archery bow has a draw length and said slots are elongated in different directions such that said grip tilts about a point adjacent said contoured back to prevent changing said draw length.

6. The archery bow as set forth in claim 1 wherein said grip includes a second side separated from said first side by a channel and wherein said channel is wider than the predetermined thickness of said handle and said grip can be moved from side to side while straddling said handle.

7. The archery bow as set forth in claim 6 wherein said first side includes a first slot and a second slot and said second side includes a third slot and a fourth slot, wherein said first slot is parallel to said third slot, said second slot is parallel to said fourth slot, and said first and second slots are elongated in different directions.

8. The archery bow as set forth in claim 7 wherein said first slot is surrounded by a first recess and said second slot is surrounded by a second recess and said bow further comprises a first washer in said first recess and a second washer in said second recess.

9. The archery bow as set forth in claim 8 wherein archery bow has a draw length and said slots are elongated in different directions such that said grip tilts about a point adjacent said contoured back to prevent changing said draw length.

* * * * *